United States Patent [19]

Böcker et al.

[11] Patent Number: 4,524,697

[45] Date of Patent: Jun. 25, 1985

[54] PROJECTILE ARRANGEMENT FOR A WEAPON HAVING A GUN BARREL

[75] Inventors: Jürgen Böcker, Oberhausen; Klaus Gersbach, Willich; Karl W. Bethmann, Moers; Gerhard Glotz, Düsseldorf, all of Fed. Rep. of Germany

[73] Assignee: Rheinmetall GmbH, Düsseldorf, Fed. Rep. of Germany

[21] Appl. No.: 396,671

[22] Filed: Jul. 9, 1982

[30] Foreign Application Priority Data

Jul. 9, 1981 [DE] Fed. Rep. of Germany ..... 3127002

[51] Int. Cl.[3] ..... F42B 11/00

[52] U.S. Cl. ..... 102/517; 102/393; 102/504; 244/3.24

[58] Field of Search ..... 102/501, 504, 517-523, 102/393; 244/3.24, 3.27, 3.1

[56] References Cited

U.S. PATENT DOCUMENTS

| | | | |
|---|---|---|---|
| 1,321,667 | 11/1919 | Phelps | 102/504 |
| 1,343,747 | 6/1920 | Radakovich | 102/504 |
| 2,348,240 | 5/1944 | Braun | 120/393 |
| 2,368,587 | 1/1945 | Wise | 102/504 |
| 3,665,861 | 5/1972 | Jaslow | 102/506 |
| 4,212,244 | 7/1980 | Flatau | 102/503 |
| 4,271,761 | 6/1981 | Canning et al. | 102/504 |
| 4,327,644 | 5/1982 | Stancil | 102/504 |

*Primary Examiner*—Harold J. Tudor

[57] ABSTRACT

A projectile arrangement for a gun barrel weapon having a plurality of sub-caliber projectiles which are mounted on a common sabot which is composed of a plurality of segments. These projectiles are designed for a sequential flight one behind the other at predetermined distances and along a common flight path and are joined to each other by means of a wire. The leading projectile deactivates a detonating charge upon impacting on a target region of a "actively armored" target, so that the next following projectiles can become target-effective without being disturbed.

1 Claim, 4 Drawing Figures

PROJECTILE ARRANGEMENT FOR A WEAPON HAVING A GUN BARREL

BACKGROUND OF THE INVENTION

The invention relates to a projectile arrangement for weapons having gun barrels. Such projectile arrangements are of the type disclosed in U.S. Pat. No. 3,665,861. Such projectiles have as an object to damage as large an area of its target as possible with one single shot.

Targets which have the most modern armor-plated protection, above all such targets which consist of multi-plated armor and include in the outermost armor region a detonating charge for rendering the impacting projectile ineffective, require corresponding complex means for combatting them. A primary object of such projectiles must therefore be to deactivate such "active armor" detonating charge and thereby to render harmless such "active armor" in the corresponding target region so that the target may be further combatted.

After deactivation of the "active armor" further steps may be taken against the target region Known projectile arrangements are not fully effective against the type of "active armor" discussed herein. This is because of the scattering of the first shot, which results in at best a plurality of target regions being deactivated in the afore-described sense known arrangements require a second shot, whose impact region must be substantially identical to that of the preceding first shot in order to penetrate the target. This, however, even with a non-movable armored target, according to experience, is highly unlikely.

SUMMARY OF THE INVENTION

It is a general object of this invention to provide a projectile arrangement which is particularly suitable for combatting so-called "active armored" targets, with a high probability of destroying such targets.

DESCRIPTION OF THE DRAWING

With this and other objects in view, which will become more apparent in the following detailed description, the present invention, which is shown by example only, will be clearly understood in connection with the accompanying drawing, in which.

DETAILED DESCRIPTION

Figure 1:
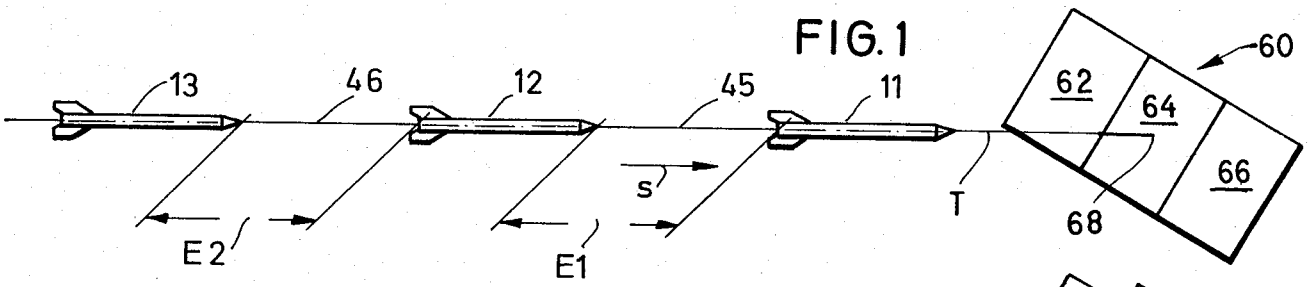
FIG. 1 illustrates schematically three projectiles traversing a common flight path toward a multiplated target and being axially spaced from each other, which projectiles are joined to each other by means of a wire.

According to the projectile arrangement of FIG. 1, there are provided three successive projectiles 11, 12 and 13, one behind the other which have, for purposes of clarity and simplicity, been illustrated as traversing and following a straight common flight path T having an end or impact point 68 (theoretical) on a first armor plate 64 disposed between two armor plates 62 and 66 of a simplified and schematically illustrated, "active armored" target 60. The lead projectile 11, which moves in the direction indicated by the arrow S, is connected by means of a wire 45 to a second projectile 12 which follows the projectile 11 at a distance E1. The second projectile 12 is connected by means of a wire 46 to a third projectile 13 which follows projectile 12 at a distance E2. Again, for purposes of clarity, the distances E1 and E2 are illustrated shortened end of equal length. As soon as the lead projectile 11 impacts the armor plate 64 it releases a non-illustrated detonating charge. Thereby the armor plate 64, relative to the adjoining armor plates 62 and 66, is "accelerated" or moved in a non-illustrated and not further described manner, thus disturbing the projectile 11 and substantially inhibiting its effect on the target region.

Figure 2:
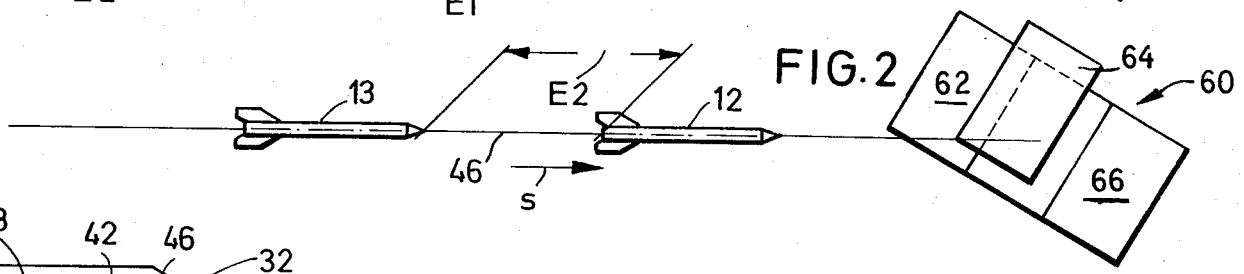
FIG. 2 illustrates the projectile arrangement in accordance with FIG. 1 after the first or lead projectile has become effective in the sense of deactivating a target region of a multi-plated target.

In FIG. 2 the armor plate 64, now identified as 64', is illustrated schematically during its acceleration and projectile 11 is no longer illustrated. The detonating charge which pertains to the armor plate 64 (64') has now been deactivated by projectile 11. The next following projectile 12, which follows at a distance E1, and is also directed onto the region of the armor plate 64 (64') can now be effective without disturbance, and the next following projectile 13, which follows the same flight path T at a distance E2 from the projectile 12, further enlarges the destructive effect at the corresponding target region.

Figure 3:
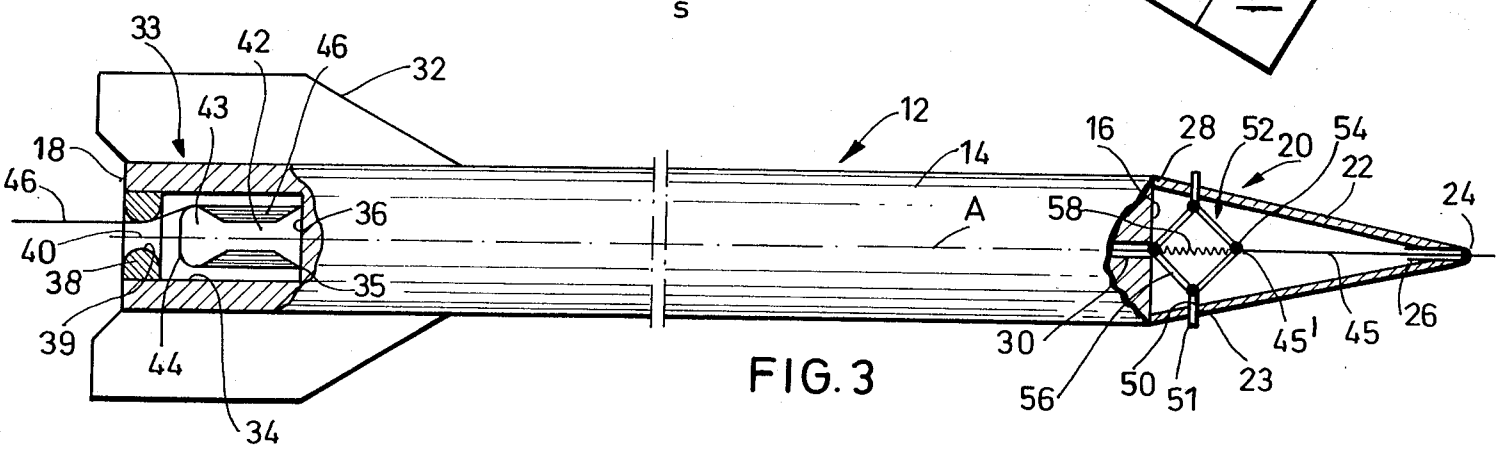
FIG. 3 is a view partially in side elevation and partially in cross-section, of an intermediate projectile, disposed behind the lead projectile in the arrangements of FIGS. 1 and 2, which intermediate projectile is illustrated on an enlarged scale, the nose and tail regions of the intermediate projectile being illustrated in cross-section to indicate the wire connections with the projectile which precedes it and the projectile which follows it.
Figure 4:
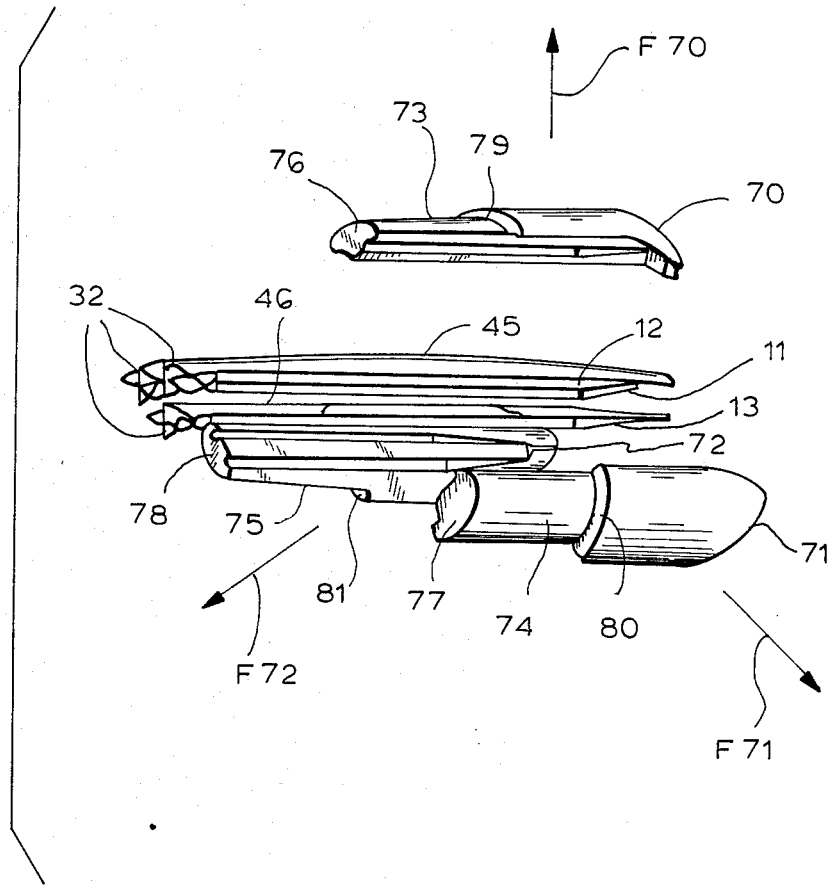

FIG. 3 illustrates the construction of intermediate projectile 12 which follows lead projectile 11 as illustrated in FIG. 1. This projectile 12 as well as projectiles 11 and 13 has a sub-caliber main projectile portion (penetrator) 14 which has a front end face 16 which has a peripheral hardened cutting edge 28 and has an annular rear end face 18. A ballistic hood 20 is mounted on the front end face 16 and is clad with a wall 22 and a nose point 24, the ballistic hood 20 being joined to the penetrator 14 in a manner which is not further illustrated in detail. At the nose point 24 there is inserted a thin nozzle pipe 26, which is only schematically illustrated, and which is coaxial with respect to the longitudinal projectile axis A. This nozzle pipe 26 serves to provide a protective guidance for the connecting wire 45 which joins the projectile 12 to the lead projectile 11 (the latter projectile being illustrated as the first projectile in FIG. 1). The rear end 45' of the connecting wire 45 is connected to an elastic tension absorbing device 58 in the region of the end face 16, which forms the first wire connection.

In the region of a stabilizing fin arrangement 32, there is provided a second wire connection in the penetrator 14 which is formed as a wire magazine 33. This second wire connection includes a cylindrical annular passage 34 provided with a front limit face 36. The rear opening of the annular passage 34, which is not illustrated in detail, is provided with an annular guide element 38, the rounded inner surfaces 39 of which define a through passage 40 (illustrated on an enlarged scale). A coil body 42 is coaxially arranged with respect to the longitudinal projectile axis A and has a front end which is attached to limit face 36 and extends through the passage 34, so that it adjoins with its free rear thickened mushroom-shaped end 43 the inner side of the guide element 38. This end 43 of the coil body 42 has a rounded exterior face 44 with an exterior diameter larger than the diameter of the through passage 40. A wire 46 is wound onto the coil body 42 for purposes of joining the next following projectile 13 to the projectile 12 via the wire 46 which is guided via the through passage 40. (The projectile 13 is illustrated in third place in FIG. 1.)

The projectiles 11, 12 and 13 exhibit at least at firing different $c_w$ (dimensionless drag coefficient)-values $a_1$, $a_2$, $a_3$, respectively, such values having the relationship $a_1 < a_2 < a_3$. (For a definition of the constant $c_w$ see WAFFENTECHNISCHES TASCHENBUCH RHEINMETALL 4th Edition, published by Rheinmetall GmbH. 1977, printed by Broenners, Druckerei Breidenstein KG. pg. 131 or The English language version entitled Handbook on Weaponry 2nd Edition, at p. 144). In order to furnish different air resistances $a_1$, $a_2$, $a_3$ for the projectiles 11, 12, 13 the two projectiles 12 and 13 which follow projectile 11 are provided with at least two airfoils 50 (see FIG. 3), whereby $a_1 < a_2 < a_3$.

In order to furnish larger values of $a_2$ and $a_3$ relative to the value $a_1$, each of the next following projectiles 12 and 13 (projectile 12 in FIG. 3 is illustrative) includes at least two diametrically opposed airfoils 50 with free ends 51, which extend through passages 23 in the wall 22 of the ballistic hood 20. An arrangement 52 operates airfoils 50. This arrangement forms a parallelogram which includes four members that are connected to each other by means of joints 54. The free ends 51 of the airfoils 50 extend radially outward from the parallelogram past the exterior periphery of the ballistic hood 20. Two of the pivotal joints 54 coincide with the longitudinal axis A of the projectile and are connected to the elastic tension absorbing device 58. The forward joint 54 is connected to the end 45' of the wire 45, and the rearward joint 54 is connected to front end face 16 at longitudinal axis A.

This arrangement operates so that the airfoils 50 in the starting phase assume their maximum extended position, in which the corresponding respective maximum values for $a_2$ and $a_3$ are realized. As soon as the not illustrated respective parts of the sabot separate from the projectiles 11, 12 and 13 after leaving the non-illustrated muzzle of the gun barrel, the projectiles 12 and 13 assume the predetermined distances E1 respectively E2 from each other due to the uncoiling of the wires 45 and 46 from the respective coil bodies 42. Once their correct flight positions have been reached, the wire end 45', as illustrated in FIG. 3, exerts a tensional pull on the front joint 54, the coil spring 58 is thereby stretched, and both airfoils 50 are retracted thus reducing the value $a_2$ along the longitudinal projectile axis A. During the relaxing of the tensional force which is transmitted by means of the wire 45 the coil spring 58 is again relaxed, the elements now move in the reverse direction again outwardly so that the value $a_2$ (respectively $a_3$) is adjusted, at which the wire 45 (respectively 46) is sufficiently taut.

On the other hand, the leading projectile 11 in flight (respectively 12) is spaced by means of the next following projectile 12 (respectively 13) not further than a predetermined value. By means of the arrangement of the invention, there is also provided in a different sense an exact sequential flight: the leading projectile 11 (respectively 12) is followed by a region in which the air resistance relative to the ambient region is reduced for the next following projectile 12 (respectively 13). When leaving the corresponding region there results, due to the increased air resistance, an increased tensional force, under the influence of which the wire 45 (respectively 46) is more strongly tensioned and due to which the arrangement 52 is actuated, whereby the next following projectile 12 (respectively 13) can again be returned into the more favorable region.

Although the invention is illustrated and described with reference to one preferred embodiment thereof, it is to be expressly understood that it is in no way limited to the disclosure of such preferred embodiment but is capable of numerous modifications within the scope of the appended claims.

We claim:

1. An improved projectile arrangement for a barrel weapon having a plurality of subcaliber projectiles which are jointly mounted on a common sabot having a plurality of segments, the improvement comprising an arrangement for attaining a sequential flight of a leading projectile and a plurality of sequentially following projectiles in the same flight path after their separation from the sabot segments of the common sabot, wherein the arrangement includes wires which join the following projectiles to each other and to the leading projectile for maintaining a predetermined distance from each other along a common flight path, each following projectile having a wire connection at its nose;

an elastic tension absorbing device is interposed in the wire within the first following and second following projectiles;

wherein the projectiles exhibit, at least at firing, the following features:

(a) different air resistance values $a_1$, $a_2$, $a_3$; whereby air resistance $a_1$ corresponds to the air resistance of the leading projectile, air resistance $a_2$ corresponds to the air resistance of the first following projectile and air resistance $a_3$ corresponds to the air resistance of the second following projectile;

(b) $a_1 > a_2 > a_3$;

wherein each following projectile has at least two operatively connected retractable air foils, at least one projectile being provided with automatic means for retracting the air foils to vary the air resistance of said projectile, said automatic control means being adapted to be activated by means of a predetermined prevailing axial tensional force exerted thereon by the wire.

* * * * *